United States Patent [19]

Morrow et al.

[11] 3,950,918

[45] Apr. 20, 1976

[54] METHOD OF MAKING A DISPOSABLE PACKAGE

[76] Inventors: Darrell R. Morrow, 7 Pamela Court, Old Bridge, N.J. 08857; Michael Schuler, 62C Old New Brunswick Road, Piscataway, N.J. 08854

[22] Filed: July 30, 1974

[21] Appl. No.: 493,178

[52] U.S. Cl. ..... 53/14; 53/29; 206/217; 206/460

[51] Int. Cl.[2] ..... B65B 1/02; B65B 3/02

[58] Field of Search ..... 53/14, 29; 206/45.24, 206/45.25, 217, 218, 460, 813; 211/72–73; 229/1.5 H; 248/95, 152, 174, 346

[56] References Cited

UNITED STATES PATENTS

| | | | |
|---|---|---|---|
| 2,142,826 | 1/1939 | Rosello | 248/152 X |
| 2,331,038 | 10/1943 | Meller | 211/73 |
| 2,779,462 | 1/1957 | Hoag | 206/217 X |
| 3,130,833 | 4/1964 | Glasser et al. | 206/460 |
| 3,555,765 | 1/1971 | Wettlen et al. | 53/29 |

*Primary Examiner*—Robert L. Spruill
*Attorney, Agent, or Firm*—Edward R. Weingram

[57] ABSTRACT

A disposable container consisting of a tetrahedral-shaped chamber and a base member formed from a folded cardboard blank pre-coated with an adhesive layer and having folding guides at desired locations to provide the base with arms to hold the chamber. The chamber is formed from a segment of flexible plastic tubing, sealed at the bottom and sealed at the top on a line transverse to the sealing line at the bottom to form the tetrahedral-shaped chamber. The chamber is stably mounted on the base member, which provides a wide surface for supporting and protecting the tetrahedral chamber and also provides labeling surfaces for the container.

Also set forth is a method for manufacturing and filling containers by folding a blank pre-coated with adhesive along pre-set folding guides to form a base member, attaching the base member to a tubing segment, sealing the tubing segment at one end, filling the tubing segment, and then sealing the other end of the tubing segment on a line transverse to the first sealing line, to form a tetrahedral-shaped chamber for the container.

10 Claims, 19 Drawing Figures

METHOD OF MAKING A DISPOSABLE PACKAGE

BACKGROUND OF THE INVENTION

1. FIELD OF THE INVENTION

This invention relates to packaging and methods for manufacturing packaging and, more specifically, to packages adaptable for dispensing small quantities.

2. DESCRIPTION OF THE PRIOR ART

One of the major problems in health care administration is providing accurate doses of medication, particularly liquids and powders, to patients, whether they be in hospitals, nursing homes or in their own homes. It is desirable to minimize the amount of time spent by health care personnel in providing medication to patients, both in apportioning of the dosages and administering of the dosages to the patient, and also in the recordkeeping of the dosages administered.

For example, it has been found troublesome to apportion out quantities directly to the recipient from the large, bulk quantity each time such medication is required. Such a procedure shortens the shelf life of the medication because the numerous openings of the container exposes the contents to a possibly unfavorable environment, for example, higher temperature than recommended storage temperature, and also encourages contamination of the contents each time the bulk container is opened. Additionally, very often, liquid medications will not be homogeneous when stored in large containers and so the contents of the dosages will vary depending upon the stirring that was performed prior to each time a small quantity is removed from the large container.

Attempts to pre-package small dosages have been less than successful when dealing with doses of materials other than pills. Many problems exist regarding dispensing individual dosages of loose quantities, such as powders or liquids. In dealing with liquids, if the packages are to be sealed after being filled, which is desirable for purposes of cleanliness and avoidance of contamination and accidental spillage, then the steps of filling, sealing and then opening of the package and the dispensing of the contents all are sources of serious problems.

For example, while vial-type containers are relatively convenient for storage of small individual dosages, they usually have a relatively small opening, and are somewhat difficult to fill. Additionally, they require using an intermediate transfer member, such as a spoon, to transfer the contents from the vial to the mouth of the patient or recipient of the contents. Further, the vials are fairly bulky for the volume of material that they use, making storage prior to filling difficult. Also, vials usually are made of glass or plastic, and present disposal problems in that the discarded vials often break and shatter, leaving sharp fragments which are a hazard to other persons in the health care facility.

The use of cups for unit dosages has also proved to be less than desirable. If cups without sealed tops are used, then the dosages must be poured into open cups, where they can often remain for extended periods of time subject to contamination prior to administration to the patient. Additionally, the open cups present hazards of spilling and must be very carefully handled.

If the cups are sealed, the seals have often proved less than satisfactory in use. For example, some seals are difficult to open, so that when opening the seal, the cup is agitated or shaken to the point that the contents of the cup, if filled too near capacity, would spill. Therefore, the cups must be made substantially larger, i.e. have a much greater head space than is necessary for the contents of the fluid that they hold. Also, if the cups are filled to near the top, it is difficult for the contents of the cup to be taken by the patient in a lying position, so that the cups again must be made much larger than is necessary for the quantity of material to be dispensed.

The relatively large size of the cup in relation to the quantity of material to be dispensed presents problems regarding retention of a portion of the contents due to the wetted surface of the cup. When dealing with relatively small quantities of liquids, the quantity of liquid retained can seriously affect the accuracy of the dosage.

Additionally, cups are often made of plastic materials which cannot be disposed of conveniently. For example, plastic cups very often shatter and, like vials, produce fragments which present dangers to the personnel handling the disposed products.

Additionally, most packages adapted for dispensing small quantities often require a separate labeling operation. A label must be produced and then placed on the container. Often these labels fall off or the wrong labels are inserted or other problems arise regarding the labeling. Further, the extra step of labeling adds to the cost of packaging of the dose in the container.

Lastly, when using containers which cannot be completely sealed in advance, it is necessary for the dosage to be apportioned near the patient who is to receive it. Thus, it makes centralized recordkeeping of the history of medication administered to patients extremely difficult, tending to increase the cost of recordkeeping for the health care facility.

SUMMARY OF THE INVENTION

In order to overcome the problems set forth above and other problems inherent in the prior art relating to containers adapted for containing small quantities of materials, the present invention sets forth a disposable container consisting of a tetrahedral-shaped chamber and a base member formed from a folded cardboard blank pre-coated with an adhesive layer and having folding guides at desired locations to provide the base with arms to hold the chamber. The chamber is formed from a segment of flexible plastic tubing, sealed at the bottom and sealed at the top on a line transverse to the sealing line at the bottom to form the tetrahedral-shaped chamber. The chamber is stably mounted on the base member, which provides a wide surface for supporting and protecting the tetrahedral chamber and also provides labeling surfaces for the container.

Also set forth is a method for manufacturing and filling containers by folding a blank pre-coated with adhesive along pre-set folding guides to form a base member, attaching the base member to a tubing segment, sealing the tubing segment at one end, filling the tubing segment, and then sealing the other end of the tubing segment on a line transverse to the first sealing line, to form a tetrahedral-shaped chamber for the container.

Accordingly, in view of the above, it is an object of the present invention to provide a container for holding and dispensing relatively small quantities of material, which has a separate base member for supporting a sealed chamber to hold the material contained in the chamber.

It is another object of the present invention to provide a container for holding and dispensing relatively small quantities of material, which is relatively inexpensive to manufacture.

Still another object of the present invention is to provide a container having high structural integrity when filled.

It is a further object of the present invention to provide a container which is strong enough to prevent crushing of the contents after the container is assembled.

Yet another object of the present invention is to provide a container which adequately protects the product from crushing or leakage or unnecessary exposure to the environment after the product is placed in the container and the container is sealed.

It is an added objected of the present invention to provide a container which is stable after the container is filled and after the filled container is opened.

Yet another object of the present invention is to provide a container which can be hermetically sealed, which can hold either liquids or powders, and which is easily adaptable for flushing with an inert gas.

A further object of the present invention is to provide a container which can be easily deformed to assist in both the filling and emptying of the container.

It is yet another object of the present invention to provide a container which provides a large filling aperture for a relatively small chamber, for ease in filling.

Additionally, it is an object of the present invention to provide a container which is transparent for easy visual observation of contents and dispensing of contents.

Another object of the present invention is to provide a container which can form a pouring spout when the container is opened.

It is still another object of the present invention to provide a container designed to enable large quantities of containers to be easily and conveniently stored.

A further object of the present invention is to provide a container which is made from standard components of very low volume which can be easily and conveniently stored without fear of contamination from extended exposure to normal environment.

It is yet another object of the present invention to provide a container which can be easily opened so that the package need have provisions for only a minimum headspace to prevent spilling of the contents when the package is open.

An added object of the present invention is to provide a container which has low wettability of the chamber surface, resulting in a low or minimal dosage retention requiring a minimum overfill of the container.

It is another object of the present invention to provide a container which can easily be disposed of, without presenting problems as to bulk or hazardous fragments when being disposed.

Still another object of the present invention is to provide a container having a chamber which can be easily varied to vary the volume of the container.

It is a further object of the present invention to provide a container having a chamber which can be precalibrated for use in filling the container with accurate dosages.

Yet another object of the present invention is to provide a container whose chamber is constructed so that the inside of the chamber is never touched during the fabrication or filling of the container.

It is an added object of the present invention to provide a container having a base which can be pre-assembled or partially assembled at one location and then the assembly of the entire container completed at a second location.

Another object of the present invention is to provide a container having components which can be separately stored in a minimum of space.

It is still another object of the present invention to provide a container which has advantage to the user of the container in that the container is easily opened by the user to minimize spilling of the contents of the container when the container is opened.

It is yet another object of the present invention to provide a container which provides high control and easy delivery of the contents to the patient, thereby reducing the chance of spilling the contents of the container when the contents are being taken by a patient.

It is another object of the present invention to provide a container which enables the contents of the container to be taken directly by a patient, without nursing assistance, because the contents of the container can be taken directly into the mouth of the patient either in a lying or sitting position and without the necessity of having an intermediate transfer medium, such as a spoon.

Still another object of the present invention is to provide a container especially adaptable for use in dispensing of medication which reduces the operations necessary for fabricating and filling the container.

It is a further object of the present invention to provide a container which is relatively easy to fill by relatively unskilled personnel, with a minimum of specialized equipment.

Yet another object of the present invention is to provide a container which is easily adaptable for coding of the contents.

It is an added object of the present invention to provide a container which provides a labeling surface directly on the container to prevent mislabeling by pasting wrong labels on containers.

Another object of the present invention is to provide a container, the use of which reduces contamination of medication from repeated opening of bulk quantities of drugs.

It is still another object of the present invention to provide a container which enables small unit dosages to be prepared individually from large quantities and then either delivered directly to the patient or stored for future use.

A further object of the present invention is to provide a container which enables a short-term supply of unit doses to be produced and stored without having to repeatedly open the bulk container of the dosage substance.

It is yet another object of the present invention to provide a container which allows for easy, centralized recordkeeping of medication history of patients.

An additional object of the present invention is to provide a container which reduces nursing time spent in administering medication to patients and reduces time spent in recordkeeping.

It is also an object of the present invention to provide a method of manufacturing a container which is relatively simple, can be performed by relatively unskilled personnel at a wide number of locations, with relatively simple and easily available tools.

Another object of the present invention is to provide a method of manufacturing a container which enables relatively large quantites of containers to be manufactured quickly and cheaply.

It is still another object of the present invention to provide a method of manufacturing a container which uses readily available components and implements in the assembly, filling and sealing of the containers.

A further object of the present invention is to provide a method of dispensing medication to patients in health care facilities which enables quantities or doses of medication to be pre-measured and packaged at a location remote from the location of the patient, transported to the patient for consumption, and then have the containers disposed of with a minimum of difficulty.

An added object of the present invention is to provide a container which can be provided with a reusable sealing component in the top portion thereof.

Other objects and advantages will be apparent from the following description of an embodiment of the invention, and the novel features will be particularly pointed out hereinafter in connection with the appended claims.

DESCRIPTION OF THE PREFERRED EMBODIMENT

Figure 1:
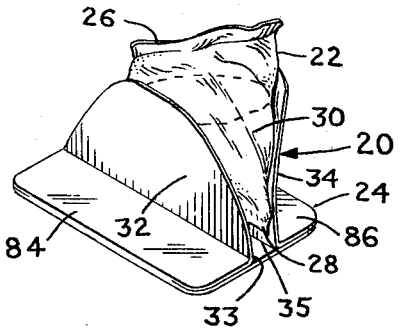
FIG. 1 is a perspective view of a CONTAINER, built in accordance with the teachings of the present invention.
Figure 2:
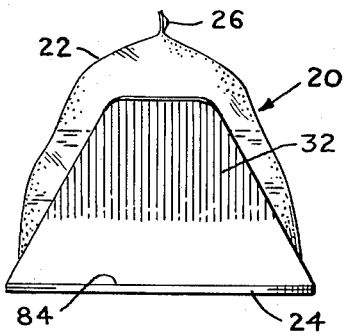
FIG. 2 is a side elevation of the CONTAINER shown in FIG. 1.

Referring to FIGS. 1 through 5, a container built in accordance with the teachings of the present invention is shown generally at 20, having a tetrahedral-shaped chamber 22 mounted on a base 24. The top sealing line 26 of chamber 22 is transverse to and, in this case, perpendicular to the bottom sealing line 28 of chamber 22 to form the tetrahedral-shaped chamber. The chamber is made initially from flat, seamless tubing, as for example, the type shown in FIG. 11, and if the tubing has been previously flattened, the chamber will have front and rear fold lines 30 on the closed chamber. The tetrahedral chamber 22 is mounted on the base 24 by being attached to left and right arms 32 and 34 respectively extending upward from left and right shoulders 84 and 86 respectively of the base having a bottom surface 36 of rectangular shape with rounded edges 38 on each corner of the base surface.

Figure 3:
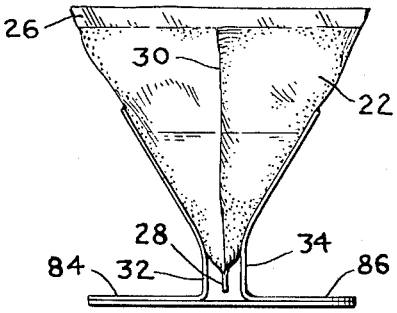
FIG. 3 is a front or rear view of the CONTAINER shown in FIG. 1.
Figure 4:
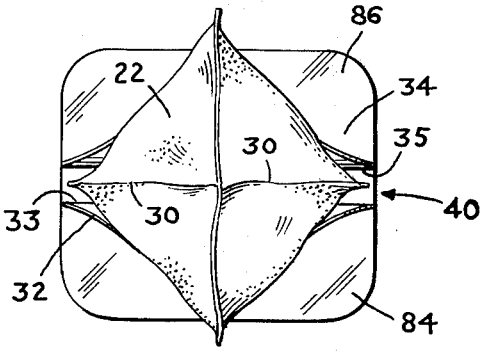
FIG. 4 is a top view of the CONTAINER shown in FIG. 1.

As shown in FIGS. 1, 3 and 4, a space 40 exists between the lines of intersection 33 and 35 at which the arms 32 and 34 respectively extend upwardly from the base. This space 40 serves an important function of spacing the arms 32 and 34 from each other to provide for enhanced stability of the tetrahedral chamber 22 when connected to the arms.

Figure 6:
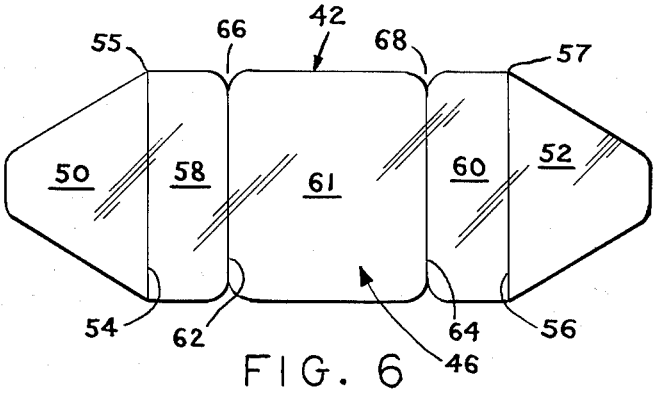
FIG. 6 is a bottom plan view of the precut form used to fabricate the base of the CONTAINER shown in FIG. 1.
Figure 5:
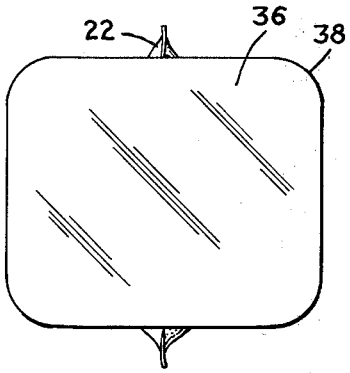
FIG. 5 is a bottom view of the CONTAINER shown in FIG. 1.
Figure 7:
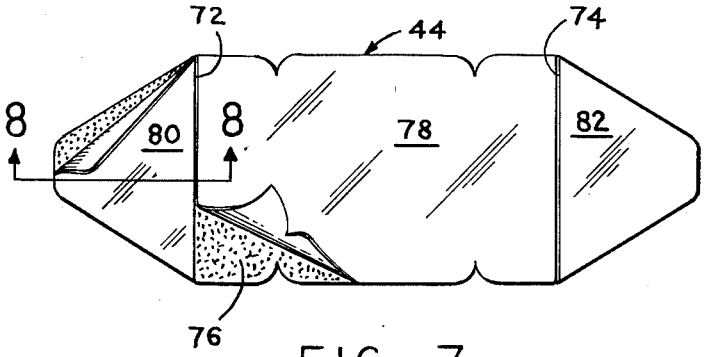
FIG. 7 is a top plan view of the precut form used to fabricate the base of the CONTAINER shown in FIG. 1.
Figure 8:
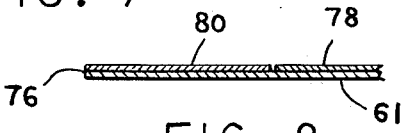
FIG. 8 is a section taken along 8—8 of FIG. 7.

As shown in FIGS. 6, 7 and 8 the base 24 of a container as shown in FIG. 1 is fabricated from a single blank, generally indicated at 42, having top and bottom surfaces 44 and 46 respectively. The blank consists of a left and right tapered arm 50 and 52 respectively, separated from the left and right rectangular shoulder sections 58 and 60 respectively, by means of folding fuides in the form of score marks 54 and 56 respectively for the left and right arms, which run between the opposite points of intersections 55 and 57 respectively of the edges of left and right arms and shoulders. The base portion 61 is separated from left and right arms 58 and 60 respectively by means of folding guides in the form of left and right score marks 62 and 64 respectively. Additionally, there are curved flared portions 66 and 68 at either end of score marks 62 and 64 respectively, which will produce the rounded corners of the base mentioned previously when the blank is property folded to form the base member.

The upper surface of the blank 42, which is used to form the base, as shown in FIG. 7, is covered with a layer of adhesive 76, over which is placed a continuous protective layer which is cut by cut marks 72 and 74 into three sections. The outer sections 80 and 82 cover the left and right arms 50 and 52 respectively while the central section 78 covers the base portion 61 and the left and right shoulders 58 and 60.

Figure 10:
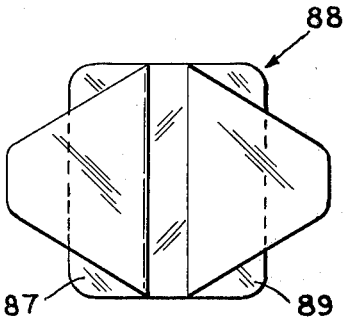
FIG. 10 shows a top plan view of a prefolded base member to be used to form the CONTAINER shown in FIG. 1.
Figure 9:
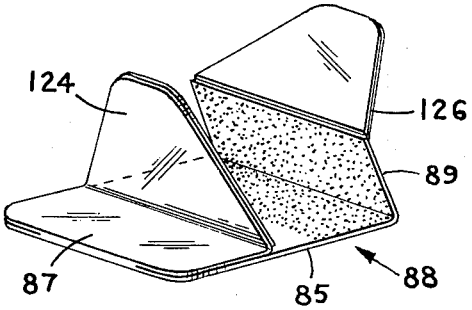
FIG. 9 is a perspective view showing the process of folding the precut blank shown in FIGS. 6, 7 and 8, to form the base of the CONTAINER shown in FIG. 1.

By removing the central protective section 78, the blank can be folded to form a partially completed base member, generally indicated at 88 in FIGS. 9 and 10, having shoulders 87 and 89 continuous with the arms and base, formed on top of a base portion 85, with arms 124 and 126 extending upwardly (as in FIG. 9, or folded flat as in FIG. 10).

The partially completed base member shown in FIGS. 9 and 10 is formed by merely folding the blank along the same score marks as shown in FIG. 6, namely outer parallel score marks equivalent to score marks 54 and 56 of FIG. 6 to form the arms and inner parallel score marks equivalent to score marks 62 and 64 of FIG. 6 to form the shoulders 87 and 89. Note that the protective covering equivalent to that of 80 and 82 in FIG. 7 has not been removed from the partially assembled base member, shown in FIGS. 9 and 10, so that the partially assembled base member can still be easily handled until it is desired to attach the base member to the partially completed chamber section.

Figure 11:
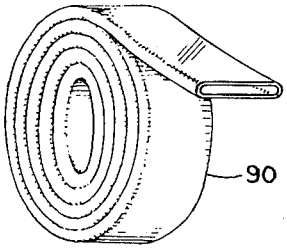
FIG. 11 shows a roll of plastic tubing used to form the sealed chamber section of the CONTAINER shown in FIG. 1.
Figure 12:
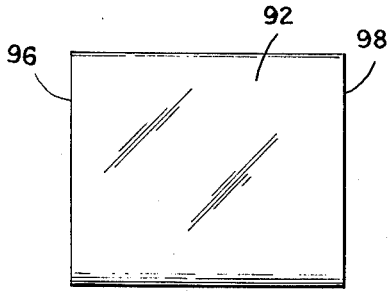
FIG. 12 shows a section of tubing which has been cut from the roll of tubing shown in FIG. 11.
Figure 13:
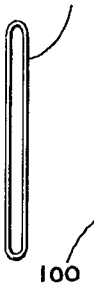
FIG. 13 is an end view of FIG. 12.
Figure 14:
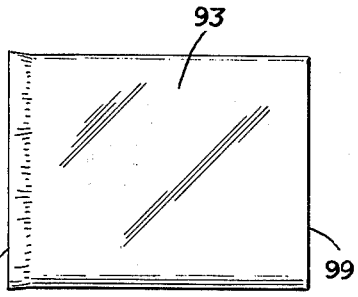
FIG. 14 shows the portion of tubing similar to the tubing shown in FIG. 12, after the tubing has been sealed on one edge thereof.
Figure 15:
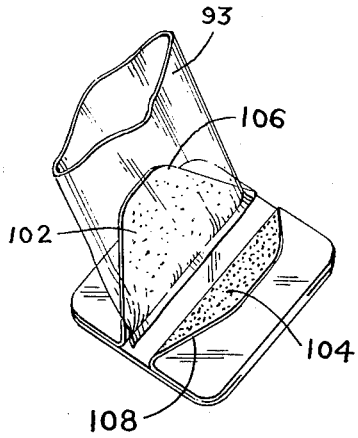
FIG. 15 shows the portion of tubing of FIG. 14, partially attached to the base of the CONTAINER.
Figure 16:
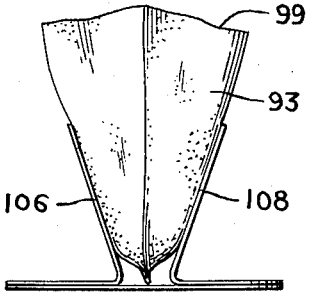
FIG. 16 shows the portion of tubing of FIG. 14 attached to both arms of the base and being supported in an upright position.

Fabrication of the chamber section of the container is accomplished with relative ease. As shown in FIG. 11, a roll of flexible plastic tubing 90 is cut into segments, such as segment 92 shown in FIG. 12, having a bottom end 96 and a top end 98. The tubing as shown in FIG. 13 has relatively thin walls 94, preferably in the order of approximately five mils thickness polyethylene. The bottom end of the tubing segment is then sealed by any standard heat sealing method, to form the segment 93 having a closed seal line 100 with an open end 99. The partially sealed tubing segment or chamber segment 93 shown in FIG. 14 is then fastened to either one of the arms 106 or 108 having exposed adhesive surfaces 102 and 104 respectively as shown in FIG. 15. After the segment 93 is connected to one of the arms of the base, the other arm is then pressed against the other side of the chamber segment 92, thereby fixing the arm to the partially completed chamber.

Figure 17:
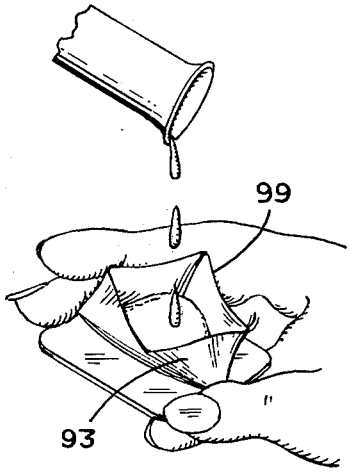
FIG. 17 shows the top of the tubing of a CONTAINER being spread, to form the aperture for filling the CONTAINER with liquid.
Figure 18:
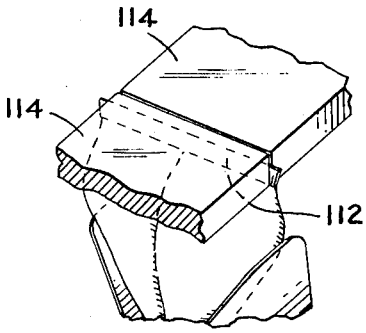
FIG. 18 shows the top of the chamber being sealed by means of a heat sealing device.

To fill the container, the tubing is squeezed at its front and back to open the unsealed top portion 99, as shown in FIG. 17, so that liquid, as from a test tube, can be easily poured into the chamber. After the chamber has been filled with the liquid dosage desired, then the top of the chamber is sealed as shown in FIG. 18 along the line 112 intersecting the two arms of the base, in other words, transverse to the bottom sealing line of the chamber. This sealing can be effected by any standard heat sealing device, generally indicated at 114, such as a "Weldotron Polystar" impulse sealer. Any other suitable type of heat sealing device can be used, the actual device used forming no part of this invention.

The sealing of the tubing section as shown in FIGS. 18 and 1 gives a three-dimensional tetrahedral shape to the chamber to hold the volume of material to be dispensed. Heat sealing of the chamber material is preferable because this provides for a liquid-tight hermetic seal of the chamber, which has many advantages over prior art non-hermetically sealed containers.

Figure 19:
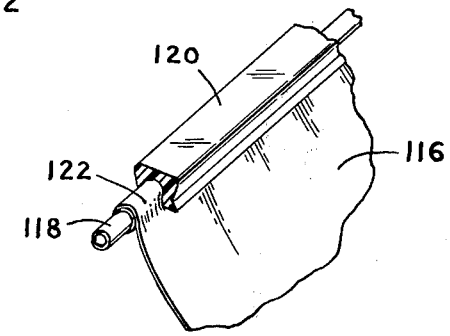
FIG. 19 shows another embodiment of the CONTAINER having a reusable means for sealing the top chamber portion of the CONTAINER.

Another method of sealing the chamber other than heat sealing is shown in FIG. 19, in which a portion 122 of a tubing segment 116 is sealed by rolling the upper end 122 over a round rod-like member 118, and then fitting a C-shaped closure clip 120 made from a flexible plastic around the rod-like member 118, thereby securely closing the top of the chamber 122 in a liquid-tight, hermetic seal.

To open the chamber, you merely pull off the C-shaped clip section 120 from the round rod section 118, opening up the entire top of the chamber.

The design of the present invention has several important advantages. If a heat seal is applied across the top, the seal can be partially or completely opened by means of scissors a nail clipper or many other conveniently available devices. Therefore, this ease of opening reduces the chances of spilling the contents during the opening process, as often happens when lids are removed from cups.

Once the container is opened, there is an unusually high control of delivery of the contents in the container. The remaining portion of the top seal line can be used to form a pouring spout for the contents from the container, so that the container can be held in the hand of the user and poured directly into the user's mouth. Since the arms of the base member are flexible, the container can be gently squeezed to expel the contents of the container so that the person receiving the medication can be sitting or standing in an upright position and still not have to incline his head backward in order to receive the medication. Further, because the opening or pouring spout can be tailored to the application, a very small opening can be made so that the patient, while in a laying position, can merely take the container and bring it to his mouth without unusual spillage, and then pour the contents of the container into his mouth, without having to rise from the laying position.

The containers can be fabricated and filled at a place remote from the location of the patient and then labeled as to the contents and, if desired, as to who is to receive the contents. All that need be done by the nursing personnel who must individually care for the patient is to bring the container to the patient and, if necessary, to quickly and easily open it by means of any handy cutting implement.

Since the container can be used as a pouring spout for direct oral consumption of the contents, it is unnecessary to use spoons or other transfer media with the container, thereby avoiding the possibility of spilling the medication and, additionally, avoiding the possibility of contamination introduced by the extra surface coming in contact with the medication.

The design of the container has many inherent advantages. The container is extremely inexpensive to manufacture, since the components of the container can be easily made from readily available commercial material. The container, when assembled and finally sealed, has extremely high structural integrity, safely enclosing the contents of the container.

It has been found that five-mil-thick polyethylene seamless tubing, two inches in diameter, provides tubing segments which are well suited to form containers for holding up to two ounces of liquid. Of course, the size of the chamber and the container can easily be varied either by lengthening the segment of tubing used, or by widening the size of tubing used.

Once filled, the arms of the container function to provide a convenient holding surface for the container and also cover a substantial portion of the chamber surface, to reduce the chances of puncturing the chamber. The design of the base provides an extremely stable support means for the chamber, both when it is filled and after it is opened. Therefore, it is possible, due to the stability of the support of the chamber, to open the chamber and place the opened container at the bedside of the patient without fear of the container toppling and spilling the contents.

The hermetically sealing capabilities of the container can be important in health care applications. The hermetic sealing capability enables medication which is to be held in the container to be loaded in the container at a point remote from the eventual point of where it will be consumed by the patient. Although the distance between the place of filling and/or the time of filling of the container and the location and/or time at which the contents are consumed may be great, the contents will remain safe and uncontaminated by environmental factors and will be safe from accidental spillage.

Since the bulk or loaded volume of the container is not established until the top of the chamber is transversally sealed to create the tetrahedral effect, the unfilled containers can be easily stored with little difficulty and will occupy a minimum of storage space. This is true whether the components are stored separately as rolls of tubing and stacks of cards, or the cards are partially assembled to form the base and shoulders while leaving the ears covered with protective tape. Though less desirable from the standpoint of contamination, the tubing segments could be connected to one or both of the arms of the base and stored in folded down position.

Since the chamber of the container is made from a flexible plastic material of low wettability, the quantity of the dosage which will be retained in the chamber, due to wetting of the chamber walls, is minimized, thereby increasing the accuracy of the dosage that will be administered by use of the container.

It should also be noted that reuse of the hermetrically sealed container will be difficult. Therefore, mistakes as to the use of contaminated articles will be avoided. Further, a container, whether of the hermetrically sealed or clip top closure design, will easily crush, since it is made out of flexible, easily disposable material, and there will be no sharp fragments remaining as there are very often with the rigid disposable plastic cups or with bottles. Further, the bulk of the disposed container will be very small, since the entire container is made from flexible components.

By making the chamber from plastic tubing which can be cut to predesired lengths, it is easy to vary the volume of the container and it is also easy to precalibrate the volume of the chamber to be made, and therefore the dosage contained, merely by having the tubing provided with appropriate marks to show the length of tubing necessary and the points at which the sealing is to occur to provide the desired volume. Further, if flattened rolls of tubing are used, the tubing can be provided in a highly clean state and even sterilized condition. Because the tubing will be in flat rolls, the inner portion of the tubing will never be exposed to the ambient conditions during storage. Further, during the actual manufacturing process, it is also unnecessary for the inside surface of the tubing ever to be contacted, therefore, reducing the possibility of contamination of the container and its contents to a minimum.

Further, the simplicity of the assembly process of the container enables the container to be produced in various locations, either in health care facilities or in pharmacies or in other areas adjacent to or even remote from the health care facility. Further, assembly process can be performed by relatively unskilled personnel. Assembly is accomplished by means of standard implements for heat sealing or possibly for clip sealing the top of the container and no specialized apparatus is necessary. Additionally, the method of assembly is extremely fast and flexible so that containers could even be prepared by staff personnel on the wards or health care facilities in their spare time.

Lastly, the simple, economical, disposable container easily lends itself to marking or coding to minimize the expenses of labeling and, additionally, the chances of confusion or mislabeling of the contents. Shoulder portions of the base member can be stenciled or typed upon with relative ease, to indicate what the contents of the container are to be, prior to the filling of the container. Therefore, the number and type of doses to be provided can be determined from a central location be merely providing the appropriate number of premarked bases to be used, and accurate records can be centrally kept as to what doses were provided for what patients at what time.

It will be understood that various changes in the details, materials and arrangements of parts which have been herein described and illustrated in order to explain the nature of the invention may be made by those skilled in the art within the principle and scope of the invention, as expressed in the appended claims.

What is claimed is:

1. A method for making a container adapted for administering unit dosages comprising the steps of:

folding a foldable blank along folding guide means to form a pair of arms upwardly extending from a base surface;

fastening a segment of tubing to and between said arms extending from said base surface said segment of tubing sealed at one end thereof to form a first sealing line, said segment of tubing disposed with said first sealing line adjacent said base surface;

simultaneously spacing said arms and opening the unsealed end of said segment of tubing to form means for holding a unit dosage;

filling said tubing segment with a unit dosage from the unsealed upper end of said segment of tubing; and sealing the open upper end of said segment of tubing to form a second sealing line transverse said first sealing line to form a tetrahedral chamber supported by said arms.

2. A method for making a container adapted for administering unit dosages according to claim 1 further comprising, before the step of folding a foldable blank along folding guide means to form a pair of arms upwardly extending from a base surface, the step of removing at least a portion of a protective layer covering adhesive means disposed on said pre-shaped foldable blank.

3. A method for making a container adapted for administering unit dosages according to claim 1, wherein said step of folding a foldable blank along folding guide means to form a pair of arms upwardly extending from a base surface includes the step of:

folding said foldable blank along folding guide means to form shoulder means connected to said base surface and said arms upwardly extending from said base surface.

4. A method for making a container adapted for administering unit dosages according to claim 1, wherein said step of folding a foldable blank along folding guide means to form a pair of arms upwardly extending from a base surface includes folding opposite ends of said foldable blank to form arms disposed in spaced relation to each other and extending upwardly from said base surface.

5. A method for making a container adapted for administering unit dosages according to claim 1, wherein:

before the step of folding a foldable blank along folding guide means to form a pair of arms upwardly extending from a base surface further comprising the step of removing at least a portion of a protective layer covering adhesive means disposed on said pre-shaped foldable blank; and said step of fastening said segment of tubing to and between said arms extending from said base surface with said first sealing line of said tubing segment adjacent said base surface includes the step of pressing said arms and tubing segment together to cause said adhesive means disposed on said arms to adhere said tubing segment to said arms.

6. A method for making a container adapted for administering unit dosages according to claim 1, wherein:

before the step of folding a foldable blank along folding guide means to form a pair of arms upwardly extending from a base surface further comprising the step of removing at least a portion of a protective layer covering adhesive means disposed on said pre-shaped foldable blank;

said step of fastening said segment of tubing to and between said arms extending from said base surface with said first sealing line of said tubing segment adjacent said base surface includes the step of pressing said arms and tubing segment together to cause said adhesive means disposed on said arms to adhere said tubing segment to said arms;

said step of folding a foldable blank along folding guide means to form a pair of arms upwardly extending from a base surface includes the steps of:

folding said foldable blank along folding guide means to form shoulder means connected to said base surface and said arms upwardly extending from said base surface; and folding opposite ends of said foldable blank to form said arms disposed in spaced relation to each other and extending upwardly from said base surface.

7. A method of making a container adapted for administering unit dosages according to claim 1 wherein before the step of fastening a segment of tubing to and between said arms, further comprising the step of sealing a segment of tubing at one end thereof to form a first sealing line.

8. A method of making a container adapted for administering unit dosages according to claim 1 wherein before the step of folding a foldable blank along folding guide means to form a pair of arms upwardly extending from a base surface, further comprising the step of sealing a segment of tubing at one end thereof to form a first sealing line.

9. A method of making a container adapted for administering unit dosages according to claim 6 wherein after the step of folding a foldable blank along folding guide means to form a pair of arms upwardly extending from a base surface and before the step of fastening a segment of tubing to and between said arms extending from said base surface, further comprising the step of removing a protective layer covering adhesive means disposed on the arm portion of said preshaped foldable blank to allow adhesive contact between said folded arms and said segment of tubing.

10. A method of making a container adapted for administering unit dosages according to claim 1 wherein said step of fastening a segment of tubing to and between said arms extending from said base surface comprises the steps of:

removing a protective layer covering adhesive means disposed on one of said arms;

pressing said segment of tubing to said uncovered adhesive means on said one of said arms;

removing a protective layer covering adhesive means disposed on the other of said pair of arms; and pressing said other of said pair of arms and said segment of tubing together to fasten said segment of tubing to and between said pair of arms.

* * * * *